US005578095A

United States Patent [19]

Bland et al.

[11] Patent Number: 5,578,095

[45] Date of Patent: Nov. 26, 1996

[54] COATED ABRASIVE ARTICLE

[75] Inventors: Ralph H. Bland, St. Paul; Joseph A. Fohrman, Cottage Grove; Raymond L. Lucking, Hastings, all of Minn.

[73] Assignee: Minnesota Mining and Manufacturing Company, St. Paul, Minn.

[21] Appl. No.: 342,577

[22] Filed: Nov. 21, 1994

[51] Int. Cl.[6] ..... B24D 11/00

[52] U.S. Cl. ..... 51/295; 51/298

[58] Field of Search ..... 51/295, 297, 298; 525/92 R

[56] References Cited

U.S. PATENT DOCUMENTS

| | | | |
|---|---|---|---|
| 3,188,265 | 6/1965 | Charbonneau et al. | 161/188 |
| 3,607,354 | 9/1971 | Krogh et al. | 117/47 R |
| 4,011,358 | 3/1977 | Roelofs | 428/287 |
| 4,563,388 | 1/1986 | Bonk et al. | 428/304.4 |
| 4,652,275 | 3/1987 | Bloecher et al. | 51/298 |
| 4,749,617 | 6/1988 | Canty | 428/332 |
| 4,799,939 | 1/1989 | Bloecher et al. | 51/293 |
| 4,906,523 | 3/1990 | Bilkadi et al. | 428/327 |
| 4,908,278 | 3/1990 | Bland et al. | 428/500 |
| 4,933,234 | 6/1990 | Kobe et al. | 428/336 |
| 5,109,638 | 5/1992 | Kime, Jr. | 51/401 |
| 5,152,917 | 10/1992 | Pieper et al. | 51/295 |
| 5,227,229 | 7/1993 | McMahan McCoy et al. | 428/283 |
| 5,304,224 | 4/1994 | Harmon | 51/295 |
| 5,316,812 | 5/1994 | Stout et al. | 51/295 |
| 5,355,636 | 10/1994 | Harmon | 51/295 |
| 5,401,560 | 3/1995 | Williams | 51/295 |
| 5,417,726 | 5/1995 | Stout et al. | 51/295 |

FOREIGN PATENT DOCUMENTS

| | | |
|---|---|---|
| WO86/02306 | 4/1986 . | |
| 1451331 | 9/1976 | United Kingdom . |
| WO94/15752 | 7/1994 | WIPO . |

*Primary Examiner*—Deborah Jones

*Attorney, Agent, or Firm*—Gary L. Griswold; Walter N. Kirn; John A. Fortkort

[57] ABSTRACT

A coated abrasive article is disclosed comprising a backing comprising an outermost layer of a paper-like polymeric film. Said film improves the slip-resistance of the article.

20 Claims, 1 Drawing Sheet

COATED ABRASIVE ARTICLE

FIELD OF THE INVENTION

This invention relates to coated abrasive articles; in particular, this invention relates to coated abrasive articles comprising a polymeric film backing.

BACKGROUND

Coated abrasives are used in a variety of applications from gate removal on forged metal parts to finishing eye glasses. Coated abrasives are also converted into a wide variety of forms, for example, endless belts, tapes, sheets, cones, and discs. Depending upon the converted form, the coated abrasive can be used by hand, with a machine, or in combination with a back-up pad.

In general, coated abrasives comprise a backing onto which a plurality of abrasive particles are bonded. Materials for backings for abrasive articles include paper, nonwoven webs, cloth, vulcanized fiber, polymeric films, including treated polymeric films, and combinations thereof. In one major form, the abrasive particles are secured to the backing by means of a first binder coat, commonly called a make coat. The make coat is applied over the backing and the abrasive particles are, at least partially, embedded in the make coat. Over the make coat and the abrasive particles can be applied a second binder coat, commonly called a size coat. The purpose of the size coat is to reinforce the abrasive particles. In a second major form, the abrasive particles are dispersed in a binder to form an abrasive composite. This abrasive composite is then bonded to the backing by means of the same binder or a different binder.

Polymeric film, for example, polyester film, has found commercial success as a backing for medium to fine grade abrasives. See, for example, U.S. Pat. No. 3,607,354 (Krogh et al.).

Polymeric film is generally very flat and smooth with even caliper and does not have surface roughness like the fibrous backings do. This flatness and smoothness results in the abrasive particles being in one plane, and thus the abrasive particles contact the workpiece being abraded at one time. This generally translates into a finer surface finish on the workpiece being abraded and typically a higher cut rate. However, when used by hand, the smooth polymeric film on the back side sometimes makes it difficult and uncomfortable for an operator to easily grab or manipulate the coated abrasive. In addition, when used in mechanical sanders, the smooth film surface may slip out of the mechanical sander's standard attachment means, requiring special attachment means to be designed.

Slip-resistant coatings may be externally applied to the backing but they generally require an additional processing step and additional expense. For example, U.S. Pat. No. 5,109,638 (Kime) discloses a coated abrasive article that contains a layer of gripper material. In the preferred embodiment, the outer exposed surface of the gripper material is provided with a textured pattern. This textured surface provides a slip-resistant surface on the back side of the abrasive article.

Another desirable property of a polymeric film backing is good or high tear resistance. In belt or disc form, the coated abrasive is rotated at relatively high speeds or revolutions. If the edge of the polymeric film backing becomes nicked, the tendency is for the backing to tear. In most applications, a torn backing then renders the entire coated abrasive inoperable and thus full utilization of the coated abrasive is not achieved.

There has been some work to improve the tear-resistance of polymeric films. For example, U.S. Pat. No. 4,908,278 (Bland et al.) discloses a multilayer film having alternating layers of ductile and brittle polymeric material.

U.S. Pat. No. 3,188,265 (Charbonneau et al.) teaches the use of an ethylene acrylic acid copolymer coating as a primer for polyester film. GB Patent No. 1,451,331 (Odell) pertains to a coated abrasive backing comprising a laminate of a polymeric film and a paper. U.S. Pat. No. 4,011,358 (Roelofs) discloses a coated abrasive backing comprising a biaxially oriented, heat-set coextruded laminate from two or more polyester polymers. One polyester layer is highly crystalline, while the other layer is taught and non-crystalline. U.S. Pat. No. 4,749,617 (Canty) discloses a rigid substrate containing an aziridine functional material. This rigid substrate can be a coated abrasive backing and the aziridine material is present between the abrasive particles/binder and the substrate. WO Published Application 86/02306 (Hansen et al.) teaches a coated abrasive backing comprising a polymeric film and a plurality of reinforcing yarns laminated to the backing. U.S. Pat. No. 5,304,224 (Harmon) teaches an abrasive article comprising a tear-resistant polymeric film.

Commercially available polymeric films currently used as coated abrasive backings include films known under the "Melinex" tradename and available from ICI.

SUMMARY OF THE INVENTION

Briefly, in one aspect, this invention provides a coated abrasive article comprising a backing having an outermost layer of microvoided polymeric film having an average surface roughness (Ra) of at least 0.2 μm. The backing has two major surfaces, a front side which is coated with abrasive particles, and a back side opposite the front side and comprising an outermost layer of the microvoided film. The microvoided films useful in this invention have a thermoplastic polyester continuous phase and a thermoplastic polyolefin discrete phase.

In a preferred embodiment, said backing comprises a multi-layered composite of polymeric film layers. The outermost layer forming the back side of the backing is said microvoided polymeric film. The other polymeric film layers comprise a multi-layer tear-resistant film, for example, that disclosed in U.S. Pat. No. 5,304,224 (Harmon).

The coated abrasive article of this invention can be prepared without an additional processing step to create a rough back side. The back surface of the microvoided polymeric film has a texture that results in the coated abrasive being more conducive for use by hand. The importance of a backing that is not slippery is that it is easier to grip by any operator's hand for a hand sander and there is less slippage when the abrasive article is used over platens or shoes in camshaft and crankshaft polishing operations. This backing has a relatively low cost as compared with other polymeric films used as coated abrasive backings, and because there is no need to apply an external slip-resistant coating, this also reduces the cost.

As used herein, "paper-like film" means microvoided film having an average surface roughness of at least 0.5 μm Ra and having a thermoplastic polyester continuous phase and a thermoplastic polyolefin discrete phase.

DETAILED DESCRIPTION

Figure 1:
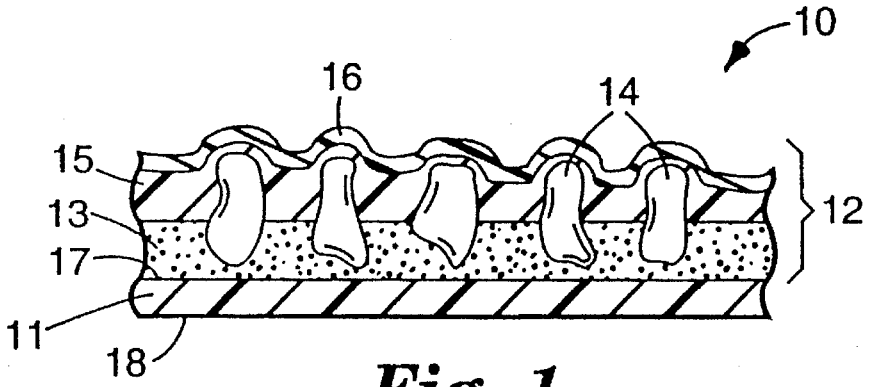
FIG. 1 is a cross-sectional view of the coated abrasive made according to one aspect of the invention.

The abrasive articles of this invention comprise a backing comprising a paper-like polymeric film. Other than the incorporation of this film, the articles of this invention can be prepared utilizing standard manufacturing techniques.

The backing of the invention has a front side and a back side. The back side of the film has this paper-like, textured, surface which is opposite the side of the abrasive coating. The front side is coated with the abrasive coating. In general, the abrasive coating comprises a plurality of abrasive particles and a binder, wherein the binder serves to secure the abrasive particles to the backing.

Of the many types of coated abrasive constructions, there are two types which are the most common. In the first type, the abrasive coating comprises a first adhesive layer, or make coat, applied to the front side of a backing and a plurality of abrasive particles at least partially embedded into the make coat. The make coat serves to secure the abrasive particles to the backing. Over the abrasive particles is a second adhesive layer, or size coat, which serves to reinforce the abrasive particles.

In the second common type of abrasive construction, the abrasive coating is formed from an abrasive slurry. The abrasive particles are distributed throughout an adhesive binder and the binder also serves to hold the abrasive particles to the backing.

There are several backing constructions that would be useful in the present invention. In each case, the paper-like film is the outermost layer of the back side of the backing.

The paper-like films useful in this invention are microvoided films having a surface roughness Ra of at least 0.2 μm. Such films comprise a thermoplastic polyester continuous phase and a thermoplastic polyolefin discrete phase. Such films may optionally contain a polyester-polyether, diblock, compatibilizer stable at the extrusion temperature of the film.

The thermoplastic polyester continuous phase generally comprises linear homopolyesters or copolyesters, such as homopolymers and copolymers of terephthalic acid and isophthalic acid. The linear polyesters may be produced by condensing one or more dicarboxylic acids or a lower alkyl diester thereof, e.g., dimethylterephthalate, terephthalic acid, isophthalic acid, phthalic acid, 2,5-, 2,6-, or 2,7-naphthalene dicarboxylic acid, succinic acid, sebacic acid, adipic acid, azelaic acid, bibenzoic acid and hexahydroterephthalic acid, or bis-p-carboxyphenoxyethane, with one or more glycols, e.g., ethylene glycol, pentyl glycol and 1,4-cyclohexanedimethanol. The particularly preferred polyester is polyethylene terephthalate.

Sufficient intrinsic viscosity is preferred in the continuous phase to yield a finished film with adequate physical properties to be useful as a backing. The intrinsic viscosity is the limiting reduced viscosity at zero concentration. Generally, the intrinsic viscosity should be greater than about 0.5 deciliters/gram in the case of polyethylene terephthalate when measured at 30° C. using a solvent consisting of 60% phenol and 40% o-dichlorobenzene (ASTM D4603).

Polymers suitable for the discrete phase include polyolefins such as polypropylene. The preferred polyolefins are those with a viscosity close to the viscosity of the polyester continuous phase at the processing conditions used (for example, temperature and shear rate). Preferably, the viscosity ratio of the polyolefin to the polyester, at the processing conditions, is from 0.3 to 3.0. If the viscosity of the polyolefin is too high (i.e., the polyolefin MFI is too low) relative to the polyester, it becomes difficult under normal processing conditions to obtain the desired polyolefin morphology in the extruder. The desired morphology consists of roughly spherical polyolefin domains smaller than approximately 50 microns in diameter, preferably smaller than 20 microns in diameter. Large polyolefin domains are undesirable because they give rise to large voids during film orientation which, in turn, can cause web breaks during processing. If the polyolefin viscosity is too low relative to the polyester, adequate dispersion of the polyolefin is obtained in the extruder; however, under normal operating conditions, the low viscosity polyolefin domains tend to elongate in the flow direction near the surface of the web adjacent to the die during extrusion. The shear rate at the die is influenced by line speed, die gap, etc. Fibrillar polyolefin domains can cause the film to be very weak in the transverse direction, making orientation in the transverse direction difficult.

The amount of added polyolefin will affect final film properties. In general, as the amount of added polyolefin increases, the amount of voiding in the final film also increases. As a result, properties that are affected by the amount of voiding in the film, such as mechanical properties, density, light transmission, etc., will depend upon the amount of added polyolefin. As the amount of polyolefin in the blend is increased, a composition range will be reached at which the olefin can no longer be easily identified as the dispersed, discrete, or minor, phase. Further increase in the amount of polyolefin in the blend will result in a phase inversion wherein the polyolefin becomes the major, or continuous, phase. Preferably, the amount of the polyolefin in the composition is from 15% by weight to 45% by weight, most preferably from 25% by weight to 35% by weight.

Additionally, the selected polyolefin must be incompatible with the matrix or continuous phase selected. In this context, incompatibility means that the discrete phase does not dissolve into the continuous phase in a substantial fashion; i.e., the discrete phase must form separate, identifiable droplets or globules within the matrix provided by the continuous phase.

The paper-like films useful in this invention may further comprise a polyester-polyether block copolymer which helps control void formation. Such copolymers will be referred to as "compatibilizers." The polyester-polyether copolymers useful as compatibilizers in this invention may change the size distribution of the discrete phase during the extrusion process. Suitable compatibilizers are those which tend to reduce the size of the largest droplets of the discrete phase. This size distribution change can be observed by comparing solid samples of different compositions. A technique which is useful in preparing samples for observation of the phases is to form or select a solid sample, place the sample in liquid nitrogen or other suitable quenching medium, and fracturing the sample. This technique should expose a fresh fracture surface which exhibits the morphology of the phases.

The compatibilizer must also withstand the thermal exposure encountered during the process of extrusion of the blend, i.e., the temperature required to process the highest melting component, which will normally be the processing temperature required of the continuous phase.

Representative examples of polyester-polyether block copolymers useful in this invention include Ecdel™ 9965, 9966, and 9967 elastomeric copolymers, available from Eastman Chamical Co. and thought to be block copolymers consisting of hard and soft segments of cyclohexane-based (1,4-cyclohexanedimethanol and 1,4-cyclohexanedicarboxylic acid) with polytetramethylene oxide segments. The different grades appear to represent varying molecular weights of approximately the same ratios of hard and soft segments. Polyester-polyether block copolymers based on polybutylene terephthalate and polytetramethylene oxide are also useful in this invention, as are similar copolymers in which another acid group, such as isophthalic acid, is substituted all or in part for the acid group of the polyester, or another glycol component is substituted all or in part for the glycol portion of either the polyester or polyether blocks. Hytrel™ thermoplastic elastomers such as G4074 and G5544, commercially available from BF Goodrich and both thought to be such polyester-ether block copolymers, are also suitable compatibilizer materials. Other examples of trade names of commercially available polyester-ether block copolymers are RITEFLEX™ (available from Hoechst-Celanese), PELPRENE™ (available from Toyobo Co., Ltd.) and LOMOD™ (available from General Electric Co.)

The process by which the paper-like film is made may also have an effect on the finished morphology and finished physical properties. Generally speaking, a paper-like film may be made by using conventional film-making technology. This includes a means of drying, blending, and supplying resins to an extruder, a means of extruding the blended materials in a manner to properly melt and adequately mix the components, an optional means of filtering the melt, a means of casting or forming of sheet (in the case of a flat film) or forming a tube or bubble (in the case of tubular extrusion or blown films), a means of orienting or stretching the sheet or tube (either sequentially or simultaneously), a means of heat-setting or stabilizing the oriented film or tube or bubble, and a means of converting the finished film or slitting the tube or bubble.

A process of dry blending the polyester, polyolefin, and optional compatibilizer has been found to be useful. For instance, blending may be accomplished by mixing finely divided, e.g., powdered or granular, continuous phase and discrete phase components and the optional compatibilizer and blending them by tumbling them together in a container. The dry blend is then fed to the extruder in a conventional manner.

Blending dry components may also be accomplished by separately feeding measured quantities of each component into the extruder hopper or throat at a rate corresponding to the desired ratio of the components desired in the finished article. The use of recycle materials may also be accomplished at this point. When feeding previously blended or extruded polyester, polyolefin, and compatibilizer materials, such as in a recycle feedstock, an appropriate adjustment in the feed rate of all other components is required to result in the final film containing the desired ratio of all components. The most common source of this type of previously blended material is recycle of by-product or trim from earlier extrusions.

Alternatively, blending of the components may be affected by combining melt streams of the continuous phase components, e.g., polyester, and the other polymeric additives during the extrusion process. A common means to accomplish this is to add the minor components by extruding them as a melt stream at the desired ratio into the extruder barrel containing the continuous phase components. The ratio of the components may then be controlled by the separate rates of the separate extruders.

If filtration of the melt stream(s) is desired, this is generally accomplished by including a filtration device between the outlet or gate of the extruder and the slot or tube die. Tubular filter elements or folded fabric filter elements are commercially available and their use is common in the polymer extrusion industry.

The extrusion, quenching and stretching or orientation of the paper-like film may be effected by any process which is known in the art for producing oriented film, e.g., by a flat film process or a bubble or tubular process. The flat film process is preferred for making paper-like film and involves extruding the blend through a slit die and rapidly quenching the extruded web upon a chilled casting drum so that the continuous phase of the film is quenched into the amorphous state. The quenched film is then biaxially oriented by stretching in mutually perpendicular directions at a temperature above the glass transition temperature of the polyester. Generally, the film is stretched in one direction first and then in a second direction perpendicular to the first. However, stretching may be effected in both directions simultaneously if desired. In a typical process, the film is stretched first in the direction of extrusion over a set of rotating rollers or between two pairs of nip rollers and is then stretched in the direction transverse thereto by means of a tenter apparatus. Films may be stretched in each direction up to 3 to 5 times their original dimension in the direction of stretching.

The temperature of the first orientation affects film properties. Generally, the first orientation is in the machine direction. Orientation temperature control may be achieved by controlling the temperature of heated rolls or adding radiant energy, e.g., by infrared lamps, as is known in the art of making polyethylene terephthalate films. Too low an orientation temperature may result in a film with an uneven appearance. Raising the machine direction orientation temperature may reduce the uneven stretching, giving the stretched film a more uniform appearance. The first orientation temperature also affects the amount of voiding that occurs during orientation. In the temperature range in which voiding occurs, the lower the orientation temperature, generally, the greater the amount of voiding that occurs during orientation. As the first orientation temperature is raised, the degree of voiding decreases to the point of elimination.

Generally, a second orientation in a direction perpendicular to the first orientation is desired. The temperature of such second orientation is generally similar to or higher than the temperature of the first orientation.

After the film has been stretched it may be further processed or heat set by subjecting the film to a temperature sufficient to further crystallize the polyester continuous phase while restraining the film against retraction in both directions of stretching.

The paper-like film may, if desired, conveniently contain additives conventionally employed in the manufacture of thermoplastics polyester films. Thus, agents such as dyes, pigments, fillers, voiding agents, lubricants, anti-oxidants, anti-blocking agents, anti-static agents, surface active agents, slip aids, gloss-improvers, prodegradants, ultraviolet light stabilizers, viscosity modifiers and dispersion stabilizers may be incorporated, as appropriate.

In one embodiment, the paper-like film alone is used as the coated abrasive backing. In another embodiment, the paper-like film is extruded or laminated onto another polymeric film to give a multi-layer film that is used as the coated abrasive backing. This other polymeric film can be a polyester film, a polyethylene film, a polypropylene film, a polyamide film, or multi-layer combinations thereof.

It is preferred to extrude the paper-like film onto a tear-resistant film, such as disclosed in the Harmon patent supra or to coextrude the two films together. This tear-resistant film comprises alternating layers of a stiff polyester film and a ductile co-polyester film. There may be, for example, from about 3 to 63 of these alternating layers. Multi-layered film comprising tear-resistant layers and an outermost paper-like layer, can be tear-resistant, while having a slip-resistant back side.

The coated abrasive backing may also be a laminate of the paper-like film, or the multi-layer film of paper-like film and tear-resistant film, with a substrate other than polymeric film. Useful substrates include cloth, paper, nonwovens, vulcanized fiber, and combinations thereof. Cloth substrates are preferably treated with a resinous adhesive to protect the cloth fibers and to seal the cloth. The cloth can be a woven, knitted, or stitchbonded cloth. The cloth can be made of cotton yarns, polyester yarns, rayon yarns, silk yarns, nylon yarns, and combinations thereof. Nonwoven substrates can be made of cellulosic fibers, synthetic fibers, or a combination of cellulosic fibers and synthetic fibers.

The paper-like film or the multi-layer film can be laminated to substrates by well-known techniques and any suitable laminating adhesives. The laminating adhesive can be a thermoplastic such as nylon resins, polyester resins, polyurethane resins, polyolefins, and combinations thereof. The laminating adhesive can also be a thermosetting resin such as phenolic resins, aminoplast resins, urethane resins, epoxy resins, ethylenically unsaturated resins, acrylate isocyanurate resins, urea-formaldehyde resins, isocyanurate resins, acrylate urethane resins, acrylate epoxy resins, and combinations thereof. The choice of the substrate and the laminating adhesive is selected so as to provide the properties desired in a coated abrasive backing such as strength, heat resistance, tear resistance, and flexibility.

The side of the backing facing the abrasive particles may contain a primer to increase the adhesion of the first adhesive layer or make coat. Examples of primers include mechanical and chemical primers. The primer can be a surface alteration or chemical type primer. Examples of surface alterations include corona treatment, UV treatment, electron beam treatment, flame treatment, and scuffing to increase the surface area. Examples of chemical type primers include ethylene acrylic acid copolymer as described, for example, in U.S. Pat. No. 3,188,265 (Charbonneau et al.); colloidal dispersions as taught, for example, in U.S. Pat. No. 4,906,523; and aziridine-type materials as taught, for example, in U.S. Pat. No. 4,749,617 (Canty). Other primers include radiation grafted primers as taught, for example, in U.S. Pat. Nos. 4,563,388 and 4,933,234. Still another technique for priming is by exposure of the polymeric film to ultraviolet light as taught, for example, in U.S. Pat. No. 5,227,229.

Referring to FIG. 1, the coated abrasive article 10 has paper-like film as the backing 11. The backing has a front side 17 and back side 18. Bonded to the front side of the backing is an abrasive coating 12. The abrasive coating consists of a make coat 13 which serves to bond the abrasive particles 14 to the backing. Overlaying the abrasive particles and the make coat is size coat 15. Optionally, overlaying the size coat is a supersize coat 16.

Figure 2:
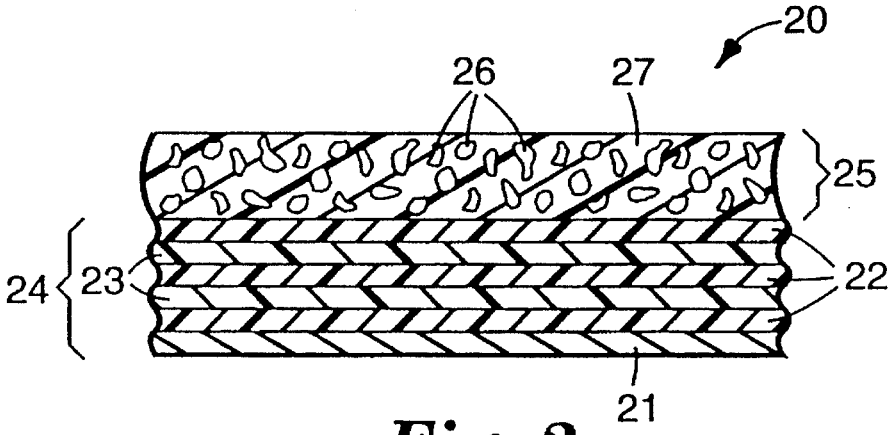
FIG. 2 is a cross-sectional view of the coated abrasive made according to another aspect of the invention.

Referring to FIG. 2, this figure illustrates a second embodiment. The abrasive article 20 comprises a backing 24 having an abrasive coating 25 bonded to the backing. The backing 24 comprises alternating layers of a hard polyester film 22 and a tough co-polyester 23. These alternating layers result in a very tear-resistant polymeric film. The very last layer (on the back side) of the construction 21 is the paper-like film. This results in the back side of the coated abrasive having a textured and graspable surface. The abrasive coating 25 comprises a plurality of abrasive particles 26 dispersed in a binder 27.

Figure 3:
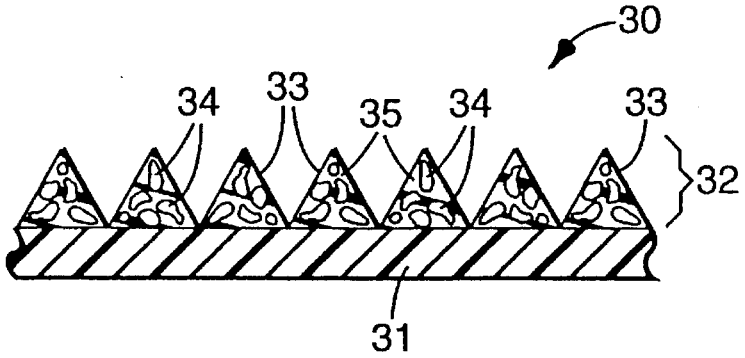
FIG. 3 is a cross-sectional view of the coated abrasive made according to another aspect of the invention.

Referring to FIG. 3, this figure illustrates another type of an abrasive article, in particular a structured abrasive article. The abrasive article 30 comprises a polymeric film backing 31 of the invention. On the front side of the backing is an abrasive coating 32 that consists of a plurality of precisely shaped abrasive composites bonded to the backing. These abrasive composites in this figure are pyramidal in shape. The individual abrasive composites 33 comprise a plurality of abrasive particles 34 distributed in a binder 35. Examples of this general type of abrasive article are known. See, for example, U.S. Pat. No. 5,152,917 (Pieper).

The make and size coat binders generally comprise a resinous adhesive. The resinous adhesive is selected such that it has the suitable properties necessary for an abrasive article binder. Examples of typical resinous adhesives include phenolic resins, aminoplast resins having pendant alpha, beta unsaturated carbonyl groups, urethane resins, epoxy resins, ethylenically unsaturated resins, acrylate isocyanurate resins, urea-formaldehyde resins, isocyanurate resins, acrylate urethane resins, acrylate epoxy resins, bismaleimide resins, and mixtures thereof. Depending upon the particular resinous adhesive, the binder precursor may further include a catalyst or curing agent. The catalyst and/or curing agent will either help to initiate and/or accelerate the polymerization process.

The abrasive coating and/or binder coats may further comprise optional additives, such as fillers, grinding aids, fibers, lubricants, wetting agents, antistatic agents, surfactants, pigments, anti-foaming agents, dyes, coupling agents, plasticizers, and suspending agents. The amounts of these materials are selected to provide the properties desired. Examples of fillers include calcium carbonate, calcium metasilicate, silica, silicates, sulfate salts, and combinations thereof. Examples of grinding aids include cryolite, ammonium cryolite, and potassium tetrafluoroborate.

The abrasive particles typically have a particle size ranging from about 0.1 to 1500 micrometers, usually between about 1 to 1300 micrometers. Examples of such abrasive particles include fused aluminum oxide, such as white fused or heat-treated aluminum oxide, ceramic aluminum oxide, silicon carbide, alumina zirconia, diamond, ceria, cubic boron nitride, garnet, and combinations thereof. The term abrasive particles also encompasses single abrasive particles bonded together to form an abrasive agglomerate. Abrasive agglomerates are known in the art and are described, for example, in U.S. Pat. Nos. 4,652,275 and 4,799,939.

The coated abrasive may contain an optional supersize coating which is present as the outermost coating. In one aspect, the supersize coating comprises a grinding aid and a resinous adhesive. For example, a preferred supersize comprises a mixture of an epoxy adhesive and a potassium tetrafluoroborate grinding aid. In another aspect, the supersize is present to prevent the coated abrasive from "loading". "Loading" is the term used to describe the filling of spaces between abrasive particles with swarf (the material abraded from the workpiece) and the subsequent build-up of that material. For example, during wood sanding, swarf comprised of wood particles becomes lodged in the spaces between abrasive particles, dramatically reducing the cutting ability of the abrasive particles. Examples of such loading-resistant materials include metal salts of fatty acids, urea-formaldehyde, waxes, mineral oils, crosslinked silanes, crosslinked silicones, fluorochemicals, and combinations thereof. The preferred supersize material is zinc stearate.

The coated abrasive of the type illustrated in FIG. 1 can be made by first applying the make coat in a liquid or flowable form to the front side of the backing. Next, a plurality of abrasive particles are projected, preferably by electrostatic coating, into the make coat. The resulting construction is at least partially cured or solidified. Then, the size coat is applied in a liquid or flowable form over the abrasive particles and the make coat. The size coat, and if necessary, the make coat are fully solidified or cured. The make and size coats can be applied by any number of techniques such as roll coating, spray coating, curtain coating, etc. The make and size coats can be cured or solidified either by ambient drying, or exposure to an energy source such as thermal energy or radiation energy including electron beam, ultraviolet light or visible light. The choice of the energy source will depend upon the particular chemistry of the resinous adhesive.

The coated abrasive of the type illustrated in FIG. 2 can be made by first preparing an abrasive slurry by mixing the resinous adhesive and the abrasive particles. This abrasive slurry is coated onto the first side of the backing. This coating can be accomplished, for example, by spraying, roll coating, dip coating, gravure coating, knife coating, etc. After the coating process, the resinous adhesive is solidified by either drying or the exposure to an energy source.

The coated abrasive of the type illustrated in FIG. 3 can be made by first preparing an abrasive slurry by mixing the resinous adhesive and the abrasive particles. A production tool is provided that has a plurality of cavities that correspond to the inverse shape of the desired abrasive composite shape. Next, this abrasive slurry is coated into the cavities of the production tool. The backing is brought into contact with the production tool such that the abrasive slurry wets the surface of the backing. Alternatively, the abrasive slurry can be coated onto the front side of the backing. The coated backing is brought into contact with the production tool such that the abrasive slurry flows into the cavities of the production tool. In both cases, while the abrasive slurry is present in the cavities of the production tool, the slurry is exposed to conditions (e.g., heat or radiation energy) to polymerize or cure the resinous adhesive to form the abrasive coating. This type of manufacture to make the abrasive article is known and is described, for example, in U.S. Pat. No. 5,152,917 (Pieper et al.) and in WO 94/15752 (Spurgeon et al.).

EXAMPLES

The following non-limiting examples will further illustrate the invention. All parts, percentages, ratios, etc., in the examples are by weight unless otherwise indicated. The following test procedures were utilized throughout the examples. In general, a desirable coated abrasive has a high rate of cut and a low surface finish. For the test procedures outlined below, the machine direction (MD) strips were taken from the machine direction or the vertical direction of either the backing or the actual coated abrasive. The cross direction (CD) strips were take in the cross direction or the horizontal direction of either the backing or the actual coated abrasive.

Surface Roughness

Ra is the arithmetic average of the scratch size in micrometers. Rtm is the mean of the maximum peak to valley height measured in micrometers. La is the average horizontal spacing of the roughness measured in micrometers. The measuring instrument used was a profilometer having a diamond-tipped stylus and available from Rodenstock Co. The Ra values summarized in the tables are the averages of from 3 to 5 separate Ra measurements.

Tensile Test

A coated abrasive backing sample or coated abrasive article sample was converted into a 2.5 cm by 17.8 cm strip. The strip was installed on a Sintech™ machine and tested for tensile strength. The tensile values were for the amount of force required to break the strip.

Disc Test Procedure I

A coated abrasive article sample was converted into a 10.2 cm diameter disc and secured to a foam back-up pad by means of a pressure sensitive adhesive. The coated abrasive disc and back-up pad assembly was installed on a Schiefer testing machine. The coated abrasive disc was used to abrade a polymethyl methacrylate polymer workpiece in the presence of water. The load was 4.5 kg. The endpoint of the test was 500 revolutions or cycles of the coated abrasive disc. The amount of wet polymethyl methacrylate polymer removed and the surface finish (Ra and Rtm) of the polymethyl methacrylate polymer were measured at the end of the test. The instrument used to measure the surface finish was a Perthen Perthometer M4P.

Disc Test Procedure II

Disc Test Procedure II was the same as Disc Test Procedure I, except that the workpiece used was a cellulose acetate butyrate polymer.

Push Pull Test

A coated abrasive article sample was converted into a 5.6 cm by 22.9 cm rectangular sheet. The abrasive article was secured using clips to a 1.8 kg metal block back-up pad. The coated abrasive surface contacting the workpiece was 5.6 cm by 15.1 cm. The workpiece was a 45 cm by 77 cm metal plate which contained a urethane primer. This type of primer is commonly used in the automotive paint industry. The abrasive article back-up pad was moved 90 strokes against the workpiece to sand the urethane primer. A stroke was the movement of the operator's hand in a straight line back and forth motion. The cut, i.e. the amount in micrometers of primer removed was measured after 90 strokes. The paint thickness was measured with an Elcometer coating thickness gauge 256 FTZ, sold by Elcometer Instruments Limited, Manchester, England. The surface finish Ra, i.e., the surface finish of the primer abraded, was measured after 10 cycles using a Perthen Perthometer M4P.

In Examples 1–8 and Comparative Examples C1–C4 various coated abrasive constructions were prepared and evaluated.

Example 1

A 2.8 mil (71 micrometer) thick multilayer film backing was prepared as described in U.S. Pat. No. 5,304,224 (Harmon) Example 1, except one additional outermost layer was coextruded along with the 13 layers described in Harmon. Thus, the final construction of the multilayer film backing can be represented as $A(BC)_6B$, where $(BC)_6B$ is the 2 mil thick, 13 layer film described in Example 1 of U.S.

Pat. No. 5,304,224 (Harmon), and A is a 0.8 mil thick layer of paper-like film. The B layers are the layers of polyethylene terephthalate having a DSC melting point of 256° C. as described in Example 1 of U.S. Pat. No. 5,304,224 (Harmon). The C layers are the ductile copolyesters comprising 40 mole % sebacic acid and 60 mole % terephthalic acid as described in Example 1 of U.S. Pat. No. 5,304,224 (Harmon). Layer A, the paper-like layer was a polyester-polypropylene blend comprising 30% polypropylene of melt flow index of 0.8, commercially available as Himont™ 6723.

The abrasive coating was applied to the front side of the backing, the side away from the paper-like film layer. The front side of the backing first received an ultraviolet light treatment to prime the film. The film was passed in air under seven ultraviolet lights that were defocused at 100 feet per minute (30.5 meters/minute). The backing weight was 93 grams/square meter. A make coat was first roll coated onto the front side of the backing with a weight of about 15 grams/square meter. The make coat in this example was an ethylene vinyl acetate commercially available from H. B. Fuller and Co. under the trade designation "S-6005". The make coat was 49% solids diluted with water. Next, grade 220 silicon carbide abrasive particles were electrostatically coated into the make coat with a weight of about 38 grams/square meter. The resulting construction was precured at 85° F. (29° C.) for one minute in a tunnel oven. Next, a size coat, which consisted of an aluminum chloride and ammonium chloride catalyzed urea formaldehyde resin, was roll coated over the abrasive particles. The size coat was 59% solids diluted with water and was coated with a weight of about 54 grams/square meter. The resulting construction was thermally cured for 15 minutes at 120° F. (49° C.) followed by 45 minutes at 180° F. (82° C.) to give a coated abrasive article.

Example 2

In Example 2 a coated abrasive article was made as in Example 1 except that the silicon carbide abrasive particles were replaced with grade 220 fused aluminum oxide. The abrasive particle weight was 96 grams/square meter.

Example 3

In Example 3 a coated abrasive article was made as in Example 1 except that the paper-like film layer comprised 7% polypropylene instead of 30% polypropylene. The backing weight was 89 grams/square meter.

Example 4

In Example 4 a coated abrasive article was made as in Example 3 except that the silicon carbide abrasive particles were replaced with grade 220 fused aluminum oxide. The abrasive particle weight was 96 grams/square meter.

Comparative Example C1

In Comparative Example C1 a coated abrasive article was made as in Example 2 except the backing had no paper-like film layer. The backing weight was 71 grams/square meter.

Comparative Example C2

In Comparative Example C2 a coated abrasive article was made as in Comparative Example C1 except that fused aluminum oxide abrasive particles were replaced with grade 220 silicon carbide abrasive particles. The abrasive particle weight was 38 grams/square meter.

Examples 5–8 and Comparative Examples C3 and C4

In Examples 5–8 and Comparative Example C3 and C4 coated abrasive articles were prepared as in Examples 1–4 and Comparative Example C1 and C2 respectively, except with the addition of a zinc stearate supersize.

The supersize coating formulation was prepared by mixing 72.52 parts waters, 2.4 parts cellulosic binder, 0.62 parts sulfosuccinate wetting agent, 0.5 hydrocarbon anti-foaming agent, 5 parts ethylene glycol monoethyl ether and 19 parts zinc stearate. The zinc stearate was purchased from Witco Corporation and had an average particle size of 12 micrometers. The supersize coating was applied at a weight of 42 grams/square meter.

The coated abrasives were each tested according to Disc Test Procedures I and II ("Disc I" and "Disc II") and the Push Pull Test. The test results are summarized in Table I.

TABLE I

| Article of Example | Test | Cut (g) | Ra µm | Rtm µm |
|---|---|---|---|---|
| C1 | Disc I | 1.939 | 0.90 | 5.43 |
| 4 | Disc I | 1.900 | 0.93 | 5.55 |
| 2 | Disc I | 1.970 | 0.93 | 5.88 |
| C3 | Disc II | 2.088 | 1.28 | 7.90 |
| 8 | Disc II | 2.021 | 1.45 | 8.60 |
| 6 | Disc II | 2.127 | 1.30 | 7.93 |
| C1 | Push Pull | 5.24 | 2.53 | 15.40 |
| 4 | Push Pull | 5.77 | 2.73 | 17.80 |
| 2 | Push Pull | 5.13 | 2.38 | 15.00 |
| C2 | Disc I | 2.20 | 0.98 | 6.05 |
| 3 | Disc I | 2.15 | 0.93 | 5.73 |
| 1 | Disc I | 2.05 | 1.00 | 5.95 |
| C4 | Disc II | 2.619 | 1.33 | 8.10 |
| 7 | Disc II | 2.898 | 1.45 | 9.08 |
| 5 | Disc II | 2.940 | 1.50 | 9.30 |
| C2 | Push Pull | 2.91 | 2.23 | 13.55 |
| 3 | Push Pull | 3.84 | 2.73 | 15.55 |
| 1 | Push Pull | 4.17 | 2.43 | 15.05 |

This set of grinding data shows that the polymeric film backing of the invention, which has a rough back side, provides abrasive articles which produce a cut and workpiece surface finish comparable to abrasive articles without the backings of this invention.

Example 9 and Comparative Example C5

In Example 9 a coated abrasive article was prepared as described below. The backing was a 4 mil (102 micrometer) thick paper-like film (30% polypropylene) having a MFI of 0.8 and available as Himont™ 6723. The backing weight was 78 grams/square meter.

In Comparative Example C5 a coated abrasive article was prepared as in Example 9 except that the backing was a 2 mil (51 micrometer) thick microvoided, aziridine primed, polyester film (7% polypropylene) commercially available from 3M. The backing weight was 60 grams/square meter.

In Example 9 and Comparative Example C5 a make coat was first roll coated onto the front side of the backing with a weight of about 11 grams/square meter. The make coat consisted of an aluminum chloride and ammonium chloride catalyzed urea formaldehyde resin. The make coat was 59% solids and was diluted with water. Next, grade 320 heat treated fused aluminum oxide abrasive particles were electrostatically coated into the make coat with a weight of about 42 grams/square meter. The resulting constructions were pre-cured for 20 minutes at 180° F. (82° C.). Next, a size coat which was the same chemical composition as the make coat was roll coated over the abrasive particles with a weight of about 48 grams/square meter. The resulting construction was thermally cured for 20 minutes at 180° F. (82° C.).

The polymeric film backing of Example 9 did not contain a primer and thus the adhesion of the abrasive coating to the film backing was poor. However, there was sufficient adhesion to test this coated abrasive. Example 9 and Comparative Example C5 were tested according to Disc Test Procedure II and the Tensile Test. The test results are summarized in Tables 2 and 3.

TABLE 2

| Article of Example | Test | Cut (g) | Ra µm | Rtm µm |
|---|---|---|---|---|
| 9 | Disc II | 0.684 | 1.13 | 7.98 |
| C5 | Disc II | 0.694 | 1.13 | 8.33 |

TABLE 3

| | (Tensile Test) | |
|---|---|---|
| Article of Example | MD lb./inch | CD lb./inch |
| 9 | 28.7 | 26.5 |
| C5 | 32.0 | 38.1 |

Comparative Examples C6 and C8

In Comparative C6 a coated abrasive article was prepared as in Example 9 except that the backing was a 3 mil (76 micro meter) thick polyethylene terephthalate with an ethylene acrylic acid prime coating. The tested side was the back side without the primer.

In Comparative Example C7 a coated abrasive article was prepared as in Example 9 except that the backing was a paper backing, 119 grams/square meter, commercially available from E. B. Eddy Co., under the trade designation "Sandback N-206".

In Comparative Example C8 a coated abrasive article was prepared as in Example 9 except that the backing was a 2 mil (51 micro meter) thick microvoided polyester film commercially available from ICI under the trade designation "475/200 Melinex MV". The backing weight was 60 g/M$^2$.

TABLE 4

| | (Surface Roughness) | | |
|---|---|---|---|
| Article of Example | Ra | Rtm | La |
| C7 | 3.36 | 44.5 | 20.7 |
| 1 | 0.717 | 8.53 | 29.7 |
| 3 | 0.619 | 5.05 | 23.5 |
| 9 | 0.591 | 7.44 | 25.4 |
| C5 | 0.054 | 0.534 | 17.6 |
| C6 | 0.017 | 0.151 | 15.3 |
| C8 | 0.102 | 0.724 | 24.9 |

The surface roughness data in Table 4 show that the paper-like film (Examples 1, 3, and 9) have a rough surface, similar to paper.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A coated abrasive article comprising: (a) a backing having an outermost layer of microvoided polymeric film having an average surface roughness of at least 0.2 µm Ra, wherein said microvoided polymeric film is an extrudable thermoplastic composition comprising a thermoplastic polyester continuous phase and a thermoplastic polyolefin discrete phase; and (b) an abrasive coating comprising a plurality of abrasive particles and a binder.

2. The article of claim 1 wherein the ratio of the viscosity of said polyester to said polyolefin is close enough to 1.0 so that the composition will not fibrillate during extrusion.

3. The article of claim 1 wherein the amount of polyolefin in said polymeric film is from 15% to 45% by weight.

4. The article of claim 1 wherein said polyester is a polyethylene terphthalate and said polyolefin is a polypropylene.

5. The article of claim 1 wherein said polymeric film further comprises a polyester-polyether block copolymer.

6. The abrasive article of claim 1 wherein said binder bonds the abrasive particles to said backing.

7. The abrasive article of claim 6 wherein said abrasive coating comprises a plurality of abrasive grains distributed throughout the binder.

8. The abrasive article of claim 1, wherein said abrasive coating comprises a make coat wherein said abrasive grains are at least partially embedded and a size coat overlying said abrasive grains and said make coat.

9. The abrasive article of claim 8 further comprising a supersize coat overlying said size coat.

10. A coated abrasive article, comprising:

a microvoided film having a thermoplastic polyester continuous phase, a thermoplastic polyolefin discrete phase, and an average surface roughness of at least 0.2 µm Ra;

an abrasive coating; and at least one tear-resistant layer disposed between said film and said coating.

11. The article of claim 10, wherein said article has a plurality of tear-resistant layers disposed between said film and said coating.

12. The article of claim 10, wherein said abrasive coating comprises a plurality of abrasive particles, and a binder for binding said particles to said at least one tear-resistant layer.

13. The article of claim 12, wherein said plurality of abrasive particles are dispersed throughout said binder.

14. The article of claim 10, wherein said abrasive coating comprises a plurality of pyramidal abrasive composites, said composites comprising abrasive particles dispersed throughout a binder.

15. The article of claim 12, wherein said abrasive coating comprises a first adhesive binder layer into which said abrasive particles are embedded.

16. The article of claim 15, wherein said abrasive coating further comprises a second adhesive layer disposed over said abrasive particles.

17. The article of claim 11, wherein said plurality of tear-resistant layers comprise alternating layers of polyester and copolyester resin.

18. The abrasive article of claim 10, wherein said polyester is a homopolymer or a copolymer of terephthalic acid.

19. The abrasive article of claim 10, wherein said polyolefin is polypropylene.

20. The abrasive article of claim 10 wherein said tear-resistant layer comprises at least 3 alternating layers of a stiff polyester or copolyester and a ductile sebacic acid-based copolyester.

* * * * *